US005226202A

United States Patent [19]

Griffins

[11] Patent Number: 5,226,202

[45] Date of Patent: Jul. 13, 1993

[54] LIFT-OFF HINGE ASSEMBLY

[75] Inventor: Simon J. G. Griffins, Solihull, England

[73] Assignee: IHW Engineering Limited, United Kingdom

[21] Appl. No.: 805,370

[22] Filed: Dec. 10, 1991

[30] Foreign Application Priority Data

Dec. 20, 1990 [GB] United Kingdom ..... 9027745.0
Jul. 16, 1991 [GB] United Kingdom ..... 9115310.6

[51] Int. Cl.[5] ..... E05D 7/10

[52] U.S. Cl. ..... 16/264; 16/263; 16/388; 16/335

[58] Field of Search ..... 16/145, 262, 263, 264, 16/271, 272, 308, 332, 335

[56] References Cited

U.S. PATENT DOCUMENTS 3,370,317 2/1968 Marchione ..... 16/308
4,536,918 8/1985 Brockhaus ..... 16/335
4,580,315 4/1986 Beckwith ..... 16/308
4,715,090 12/1987 Morris ..... 16/264
4,864,687 9/1989 Calcaterra et al. ..... 16/264

*Primary Examiner*—W. Donald Bray
*Attorney, Agent, or Firm*—Jones & Askew

[57] ABSTRACT

A checked lift-off hinge assembly including a pair of hinge leaves pivotally connected to one another so as to be separable by relative movement along the axis of the pivotal connection, a torsion spring mounted on one of said hinge leaves, the torsion spring extending towards and being co-operable with one or more reaction members on the other hinge leaf to provide a checking force for resisting relative pivoted movement between the hinge leaves, said one hinge leaf including positional displacement means operable on said torsion spring for moving the torsion spring to relieve spring pressure on the reaction members to thereby enable axial separation of the hinge leaves.

16 Claims, 7 Drawing Sheets

LIFT-OFF HINGE ASSEMBLY

The present invention relates to a checked lift-off hinge assembly, i.e. a hinge assembly including a check mechanism.

A lift-off hinge assembly is commonly used in the manufacture of vehicles for the hanging of doors on the vehicle body. Initially the hinge is attached to both the door and vehicle body and the vehicle is painted. The doors are then removed from the vehicle body by separating the hinges to enable both the doors and body to be fitted with additional components and furnishings. After fitting out, the doors are re-hung by reconnecting the hinges.

It is usual practice to include a door check mechanism for holding a door at a fully open or an intermediate open position. The door check mechanism may form part of the hinge assembly or it may be separate. A common type of check mechanism which is incorporated into a hinge assembly is a torsion spring which is fitted to one hinge leaf and co-operates with a pair of rollers on the other hinge leaf in order to provide the desired check on opening of the hinge. This type of hinge is desirable since it is compact and provides a strong checking force but such hinges are not of the lift-off type since the presence of the torsion spring interferes with axial separation of the hinge leafs. Interference for separation primarily occurs due to the contact pressure of the torsion spring on the rollers which necessarily rises when the door is opened to enable liftoff from the vehicle body.

A general aim of the present invention is to provide a checked lift-off hinge assembly including a torsion spring mounted on one leaf co-operable with one or more reaction members on the other hinge leaf.

According to one aspect of the invention there is provided a checked lift-off hinge assembly including a pair of hinge leaves pivotally connected to one another so as to be separable by relative movement along the axis of the pivotal connection, a torsion spring mounted on one of said hinge leaves, the torsion spring extending towards and being co-operable with one or more reaction members on the other hinge leaf to provide a checking force for resisting relative pivoted movement between the hinge leaves, said one hinge leaf including positional displacement means operable on said torsion spring for moving the torsion spring to relieve spring pressure on the reaction members to thereby enable axial separation of the hinge leaves.

Various aspects of the present invention are hereinafter described with reference to the accompanying drawings, in which.

Figure 1:
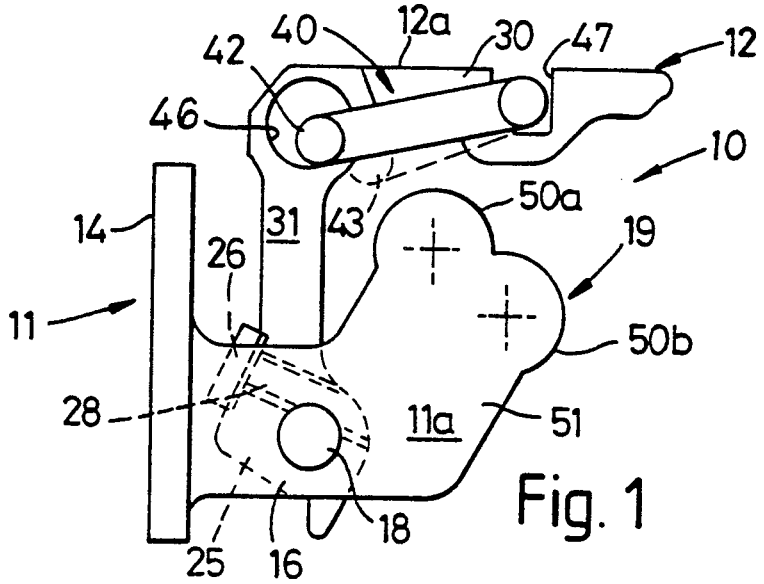
FIGS. 1 to 3 are schematic plan views of a checked hinge assembly according to the present invention shown in the closed, checked and fully open position.

Referring initially to FIGS. 1 to 5, there is shown a checked hinge assembly 10 including a first hinge leaf 11 which is normally attached to a vehicle door and a second hinge leaf 12 which is normally attached to a vehicle body.

Hinge leaf 11 comprises a body 11*a* which includes a mounting plate 14 for connection to the vehicle door, a hinge boss 16 mounted on plate 14 and a hinge check reaction means 19. A hinge pin 18 is rotatably mounted within the boss 16 and is axially restrained in the boss 16. The hinge pin 18 projects axially from boss 16 to be received in hinge boss 25 of hinge leaf 12.

Retention means 26 are provided on hinge leaf 12 to fixedly secure the hinge pin 18 to boss 25 to prevent its axial withdrawal and to prevent relative rotational movement between the hinge pin and boss 25. The retention means 26 are releasable to enable the hinge pin 18 to be axially withdrawn from boss 25 when it is required to separate the hinge leaves from one another.

In the illustrated embodiment, the retention means is preferably in the form of a threaded bolt 28 which engages the hinge pin 18 in the manner as described in our European patent specification 292296. However, it is envisaged that other forms of retention means 25 may be adopted for fixedly securing the hinge pin 18 to boss 25.

The hinge leaf 12 comprises a body 12*a* which includes a mounting plate 30 from which projects an arm 31 on which the hinge boss 25 is formed. A torsion spring 40 is mounted on body 12*a* adjacent to the mounting plate 30. The spring 40 includes an elongate body portion 44 having curved end portions which define opposed arms 42,43. In the relaxed condition, arms 42,43 may be longitudinally aligned or laterally offset. When assembled onto the hinge leaf 12 arms 42,43 are laterally displaced from their relaxed position so as to twist the body portion 44 and thereby impose a torsional bias tending to bias arms 42,43 to return to their relaxed position.

When mounted on the hinge leaf 12, the body portion 44 is received in a channel 47 in the mounting plate 30 and arm 42 is located in an enlarged bore 46 formed in an upper portion of the body 120. The arm 42 is biased toward the hinge check reaction means 19 by virtue of its lower arm 43 being constrained at a laterally offset position relative to arm 42. In the FIG. 4 embodiment, arm 43 is held in its laterally displaced position by engaging against a bolt 48 screw threadedly mounted in body 12*a*.

Figure 4:
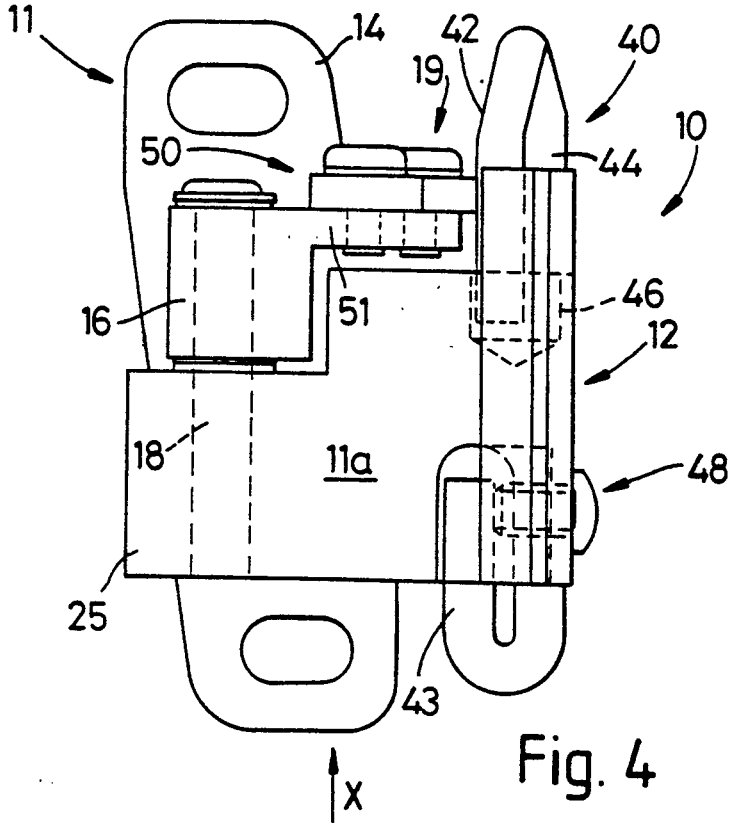
FIG. 4 is a side view of a first embodiment according to the present invention.
Figure 5:
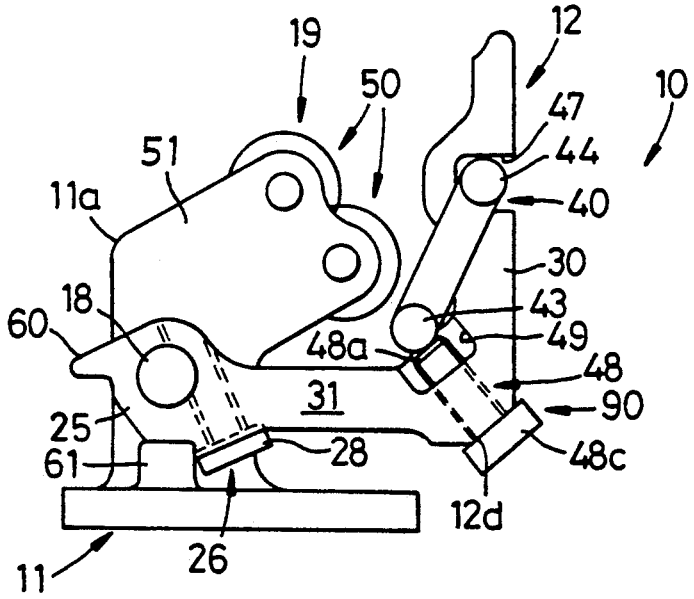
FIG. 5 is a plan view of the embodiment shown in FIG. 4 taken along view of arrow X.

As illustrated in FIGS. 4, 5 the hinge check reaction means 19 is preferably in the form of a pair of closely spaced rollers or wheels 50 which are rotatably mounted on a support arm 51 projecting from boss 16.

In use, the rollers 50 only partially rotate and so are not necessarily circular in profile. In addition recesses may be provided on the periphery of the rollers for engagement with the arm 42.

Figure 2:
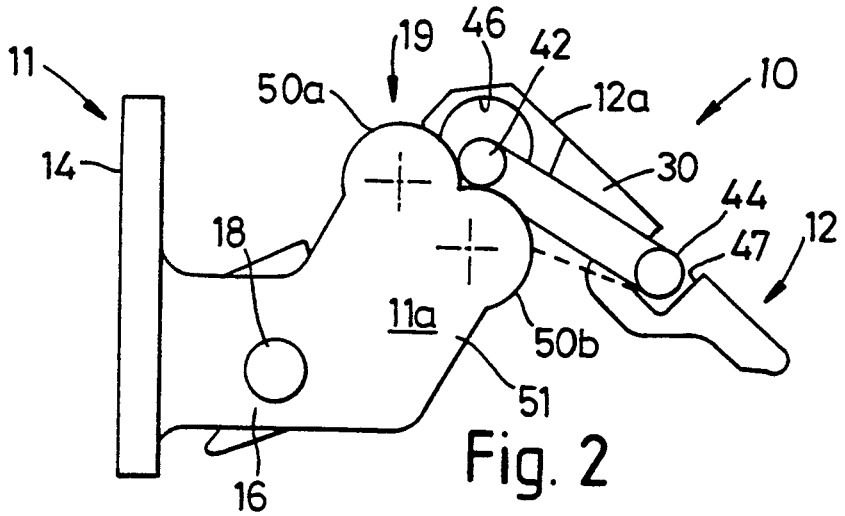
Figure 3:
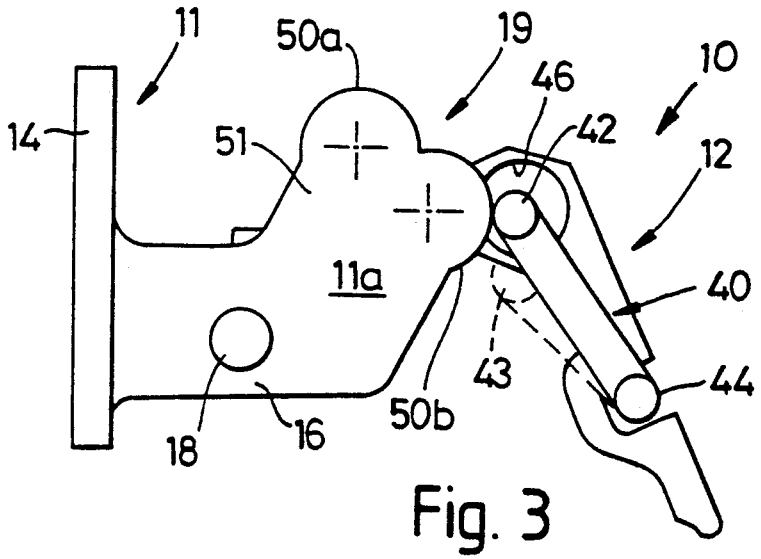

As illustrated in FIGS. 1 to 3, when the hinge assembly is in its closed position the arm 42 does not engage the reaction means 19 and so the arm 42 engages a side of the bore 46.

During initial opening of the hinge assembly, the arm 42 initially engages the first roller 50*a* and rides around its circumference. In so doing the arm 42 is deflected inwardly of the bore 46 against the torsional bias applied by body portion 44.

On reaching the nip position between rollers 50,50*b* as shown in FIG. 2, both opening and closing movements of the hinge assembly are resisted since movement in either of these directions causes inward deflection of the arm 42 against the bias of the spring body portion 44. Further opening movement toward the fully open position causes the arm 42 to ride over roller 50*b* and in so doing causes the arm 42 to be deflected inwardly of the bore 46.

Co-operating stops 60,61 are preferably provided on the hinge leaf bodies 11*a*,12*a* to define the fully open position.

As can be seen from FIGS. 1, 2 and 3 the arm 42 contacts roller 50*a* and/or 50*b* during the majority of the 'open' pivotal range of movement between the hinge leaves 11 and 12. During such range, the arm 42 applies a contact pressure on one of the rollers 50 and thereby makes it difficult or impossible to axially separate the hinge leaves on release of the retention means 26. In accordance with the present invention displacement means 90 are provided which are operable on the spring 40 in order to reduce or remove the contact pressure between the arm 42 and rollers 50 during said range of pivotal movement to thereby enable axial separation of the hinge leaves to occur at a desired pivotal position between the hinge leaves.

Figure 6:
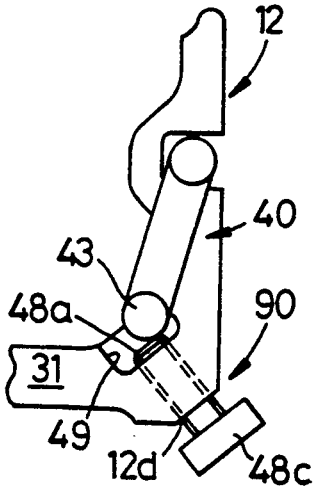
FIG. 6 is a view similar to FIG. 5 showing a portion of one hinge leaf.

In the embodiment of FIGS. 4, 5 and 6 the displacement means 90 is in the form of the bolt 48. The normal position of bolt 48 is that shown in FIG. 5 whereat the bolt 48 is extended such that its end 48*a* engages the arm 43 and holds it at the laterally displaced position to thereby create the torsional bias within body portion 44. The bolt 48 remains in this position during normal usage of the hinge assembly 10. Ideally the bolt 48 is of a self locking type to resist unthreading during use. A bolt having deformable threads would be suitable.

In order to release contact pressure between arm 42 and rollers 50, the bolt 48 is retracted into a recess 49 formed in the hinge body 12*a* thereby enabling the arm 43 to enter the recess 49 and return toward its relaxed position with arm 42. This return movement is under the torsional bias of body portion 44 and so the torsional force is reduced as the arm 43 is returned toward its relaxed position. At the relaxed position the torsional force is completely removed. This position is shown in FIG. 6. In practice, bolt 48 is retracted by a sufficient amount to reduce the contact pressure to enable axial separation of the hinge leaves. Bolt 48 is provided with a head 48*c* which preferably acts as a stop to define the fully extended position of the bolt 48 s that a desired consistent torsional force is applied by body portion 44. In addition, face 12*d* can be machined by accurate amounts to vary the effective extended length of the bolt 48 and thereby provide a means for varying the applied torsional loading during manufacture.

Figure 7:
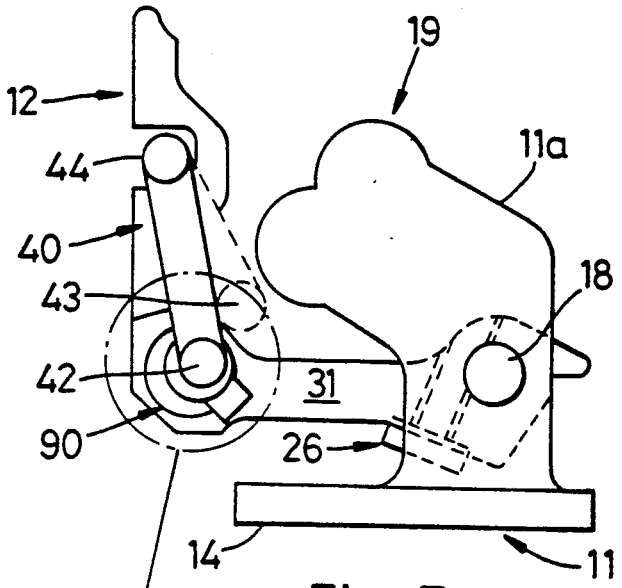
FIG. 7 is a plan view similar to FIG. 5 of a second embodiment according to the present invention.
Figure 8:
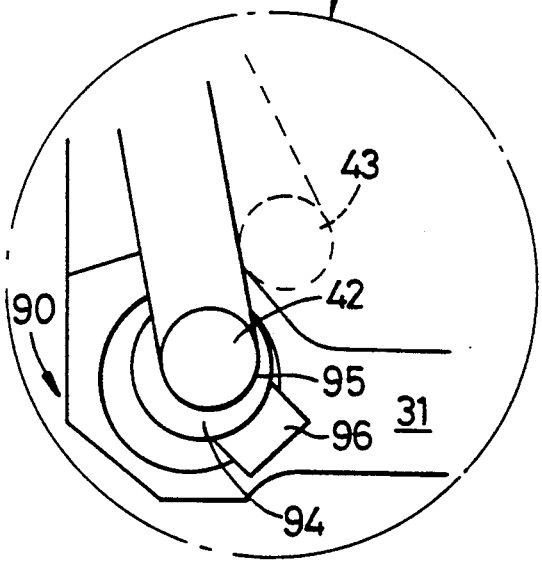
FIGS. 8 and 9 are more detailed views of part of the hinge leaf shown in FIG. 7.
Figure 9:
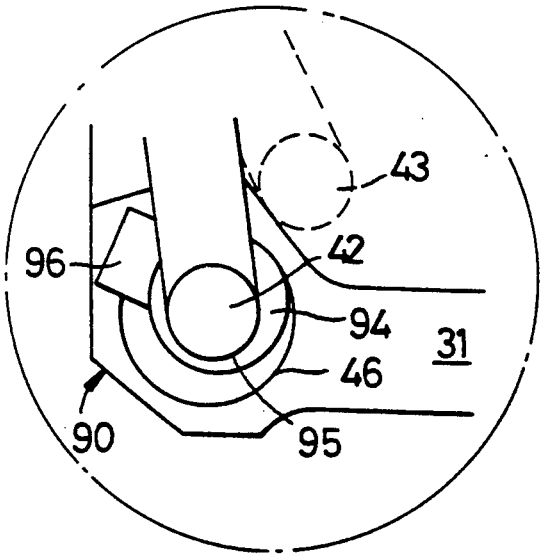

An alternative displacement means 90 is illustrated in FIGS. 7, 8 and 9. In this embodiment parts similar to those in the previous embodiment have been designated by similar reference numerals.

The embodiment of FIGS. 7 to 9 includes a displacement means 90 which is operable on the arm 42 rather than arm 43 as in the previous embodiment. The displacement means 90 in FIGS. 7 to 9 comprises a bush 94 which is rotatably mounted on arm 43. The bush 94 is located within the enlarged bore 46 and has a diameter which is less than that of bore 46 to enable inward deflection of arm 42 to occur. The bush 94 includes an eccentrically located bore 95 in which the arm 42 to move it toward or away from the side of bore 46. Conveniently the bush 94 is provided with a short radial arm 96 which an operative can use as a lever for effecting rotation of the bush.

In the normal operative condition of the hinge assembly, the bush 94 resides in the rotational position as indicated in FIG. 8 whereat the arms 42,43 reside in their laterally displaced position. In this position, the bush 94 spaces the arm 42 from the side of bore 46 by a minimum distance. In order to reduce contact pressure between arm 42 and rollers 50, the bush 94 is rotated to move the arm 42 away from the side of the bore 46 and thus away from rollers 50. In so doing, the offset distance between arms 42,43 is increased by a distance sufficient to enable axial separation of the hinge leaves.

Figure 10:
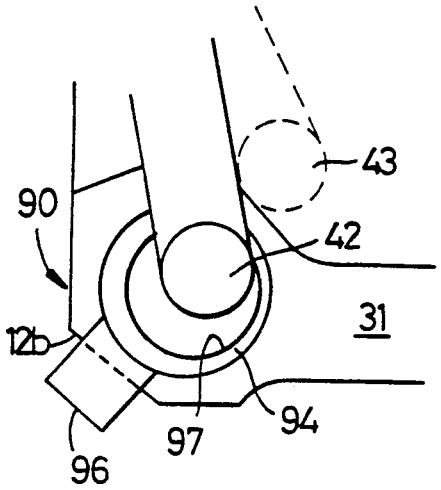
FIGS. 10 and 11 are views similar to FIGS. 8 and respectively of a further embodiment according to the present invention.
Figure 11:
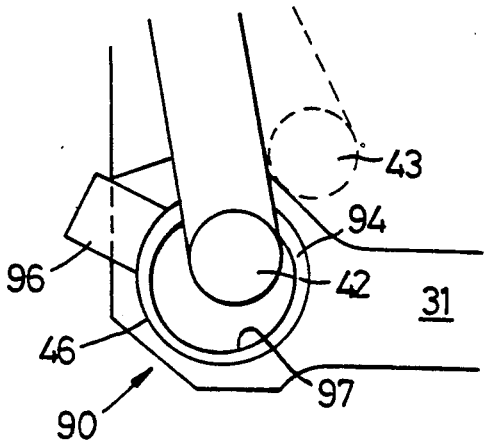

A further embodiment is shown in FIGS. 10 and 11 wherein the bush 94 has a diameter the same as that as the enlarged bore 46 so as to be rotatably received therein. In the embodiment of FIGS. 10 and 11 the bush 94 is provided with an enlarged bore 97 for accommodating the arm 42; the bore 97 being sufficiently large in comparison to arm 52 to enable the arm 42 to deflect inwardly when contacting rollers 50.

The bore 46 is eccentrically located relative to the outer circumference of the bush 94 and so rotation of the bush 94 provides a camming action on the arm 42 in the same manner as that described for the embodiment of FIGS. 7 to 9. In FIG. 10, the bush 94 is shown in its operative position for normal usage of the hinge assembly and is shown in FIG. 11 in its position for reducing contact pressure between arm 41 and rollers 50.

As seen in FIGS. 10, 11, arm 96 overhangs the body 12*a* and it is envisaged that the arm 96 could be folded over to overlap the flap 12*b* on body 12*a* to thereby hold the bush 94 in the rotational position shown in FIG. 10. This type of arm 96 could also be provided in the embodiment of FIGS. 7 to 9.

Figure 12:
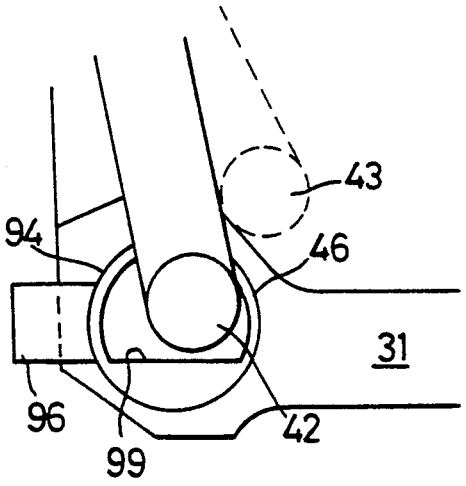
FIGS. 12 and 13 are views similar to FIGS. 8 and respectively of a further embodiment according to the present invention.
Figure 13:
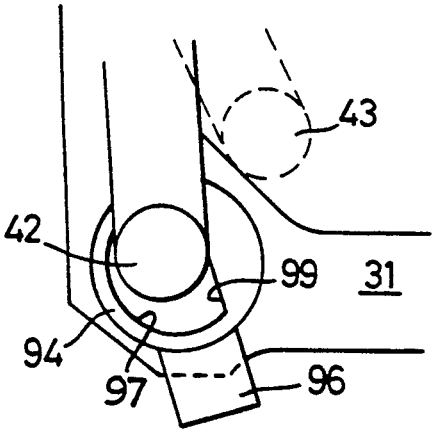
Figure 14:
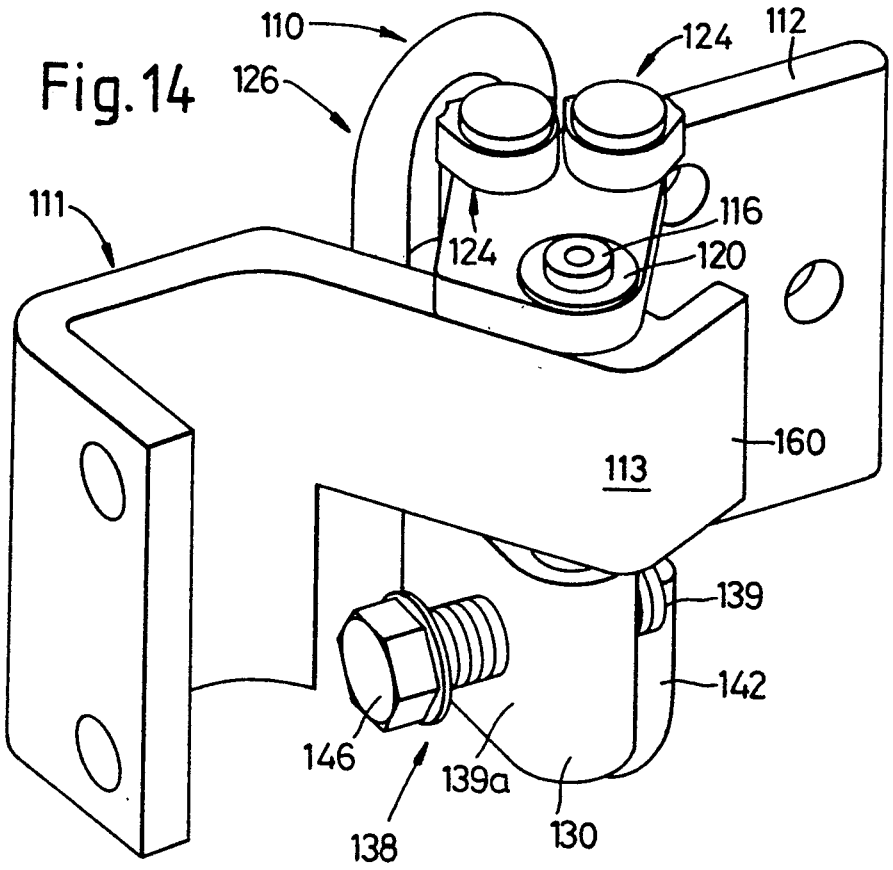
FIG. 14 is a perspective view of a further embodiment according to the present invention.
Figure 15:
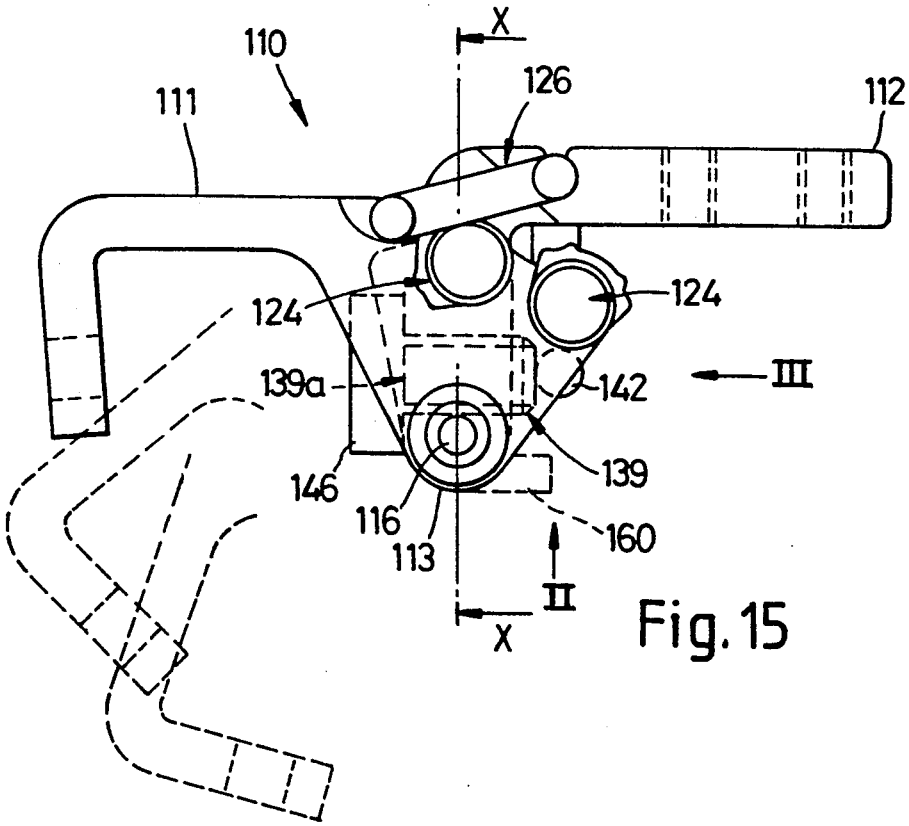
FIG. 15 is a plan view of the hinge shown in FIG. 14.
Figure 16:
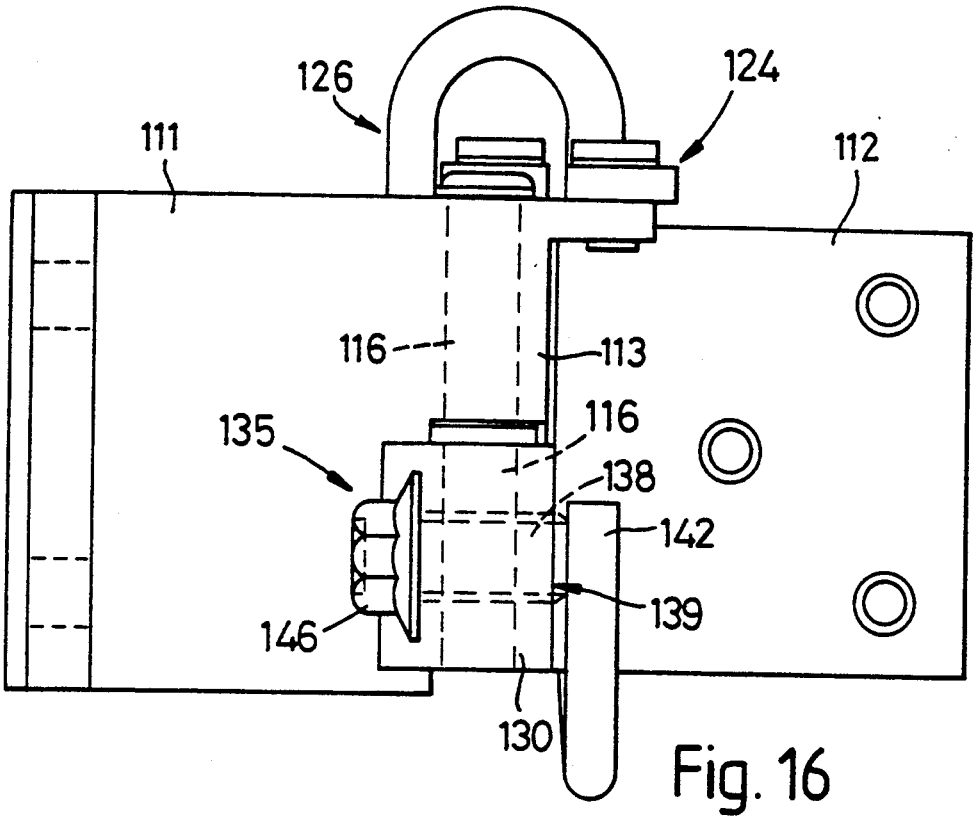
FIG. 16 is a side view of the hinge of FIG. 15 as viewed in the direction of arrow II.
Figure 17:
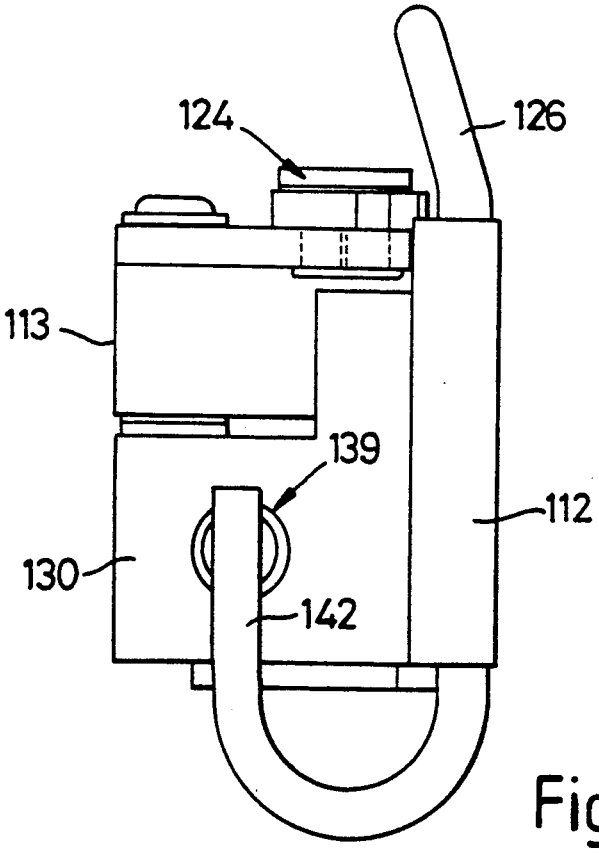
FIG. 17 is an end view of the hinge of FIG. 15 as viewed in the direction of arrow III.
Figure 18:
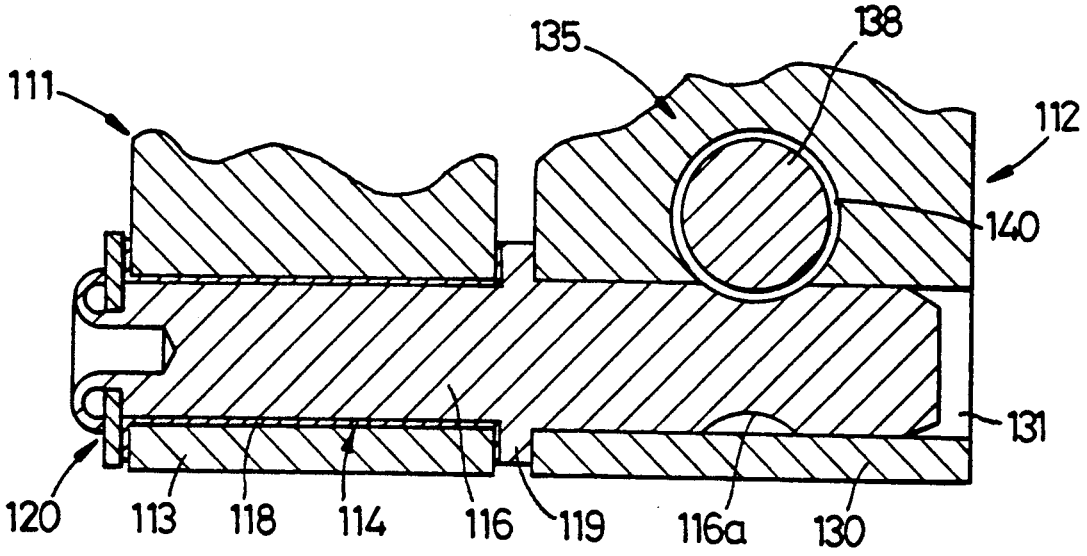
FIG. 18 is a sectional view taken along line X—X in FIG. 15.

A further embodiment is shown in FIGS. 12 and 13 wherein the enlarged bore 97 is concentrically arranged relative to the circumference of the bush 94 and is provided with a flat portion 99.

In the rotational position shown in FIG. 12, the arm 42 is located in its position for normal usage of the hinge assembly. To release contact pressure between the arm 42 and rollers 50, the bush 94 is rotated so that the arm 42 rides onto the flat portion 99 and in so doing is displaced away from the rollers 50.

The hinge 110 shown in the drawings includes a first hinge leaf 111 which is normally mounted on a vehicle door and a second hinge leaf 112 which is normally mounted on the vehicle body.

The hinge leaf 111 has a hinge pin boss portion 113 having a bore 114 in which a hinge pin 116 is rotatably mounted. A maintenance free bush 118 is preferably provided to provide for smooth rotation of the hinge pin. The pin 116 is preferably held axially captive within the bore 114 by virtue of co-operation between a shoulder formation 119 and a head portion 120.

The hinge leaf 111 has mounted thereon a pair of reaction members 124 for co-operation with a torsion spring 126 mounted on hinge leaf 112. The reaction members 124 are each preferably in the form of rotatable profiled wheels which on engagement with the torsion spring rotationally index and in so doing displace the spring to apply additional torsional load and thereby resist pivotal movement of the hinge. It will be appreciated that only one or more than two profiled wheels may be provided if desired.

The hinge leaf 112 includes a hinge pin boss 130 having a bore 131 in which the hinge pin 116 is received. Locking means 135 are provided for releasably fixedly securing the hinge pin within bore 131.

The locking means 135 is preferably defined by a bolt 138 which is screw threadedly received in a bore 140 extending transversely relative to bore 131. Bores 131,140 intersect at their peripheries such that when bolt 138 is screwed along the bore 140 its side engages and abuts against the side of the hinge pin. Preferably the hinge pin 16 is provided with an annular groove 116*a* for accommodating the bolt 138 to provide a large surface area contact. It will be appreciated that groove 116*a* may be omitted if desired The bore 140 is arranged to be open ended and the bolt 138 is of a length which enables its end portion 139 to protrude so that its end face engages with an end portion 142 of the torsion spring 126 which intersects the axis of bore 140.

Preferably the bolt 138 has a head portion 146 which engages the boss 130 to thereby ensure that the bolt projects beyond the boss 130 by a predetermined amount and thereby applies a predetermined torsional loading on the torsion spring. It will be appreciated that by varying the depth of spot facing 139*a* on the boss 113 the torsional loading can be easily modified during manufacture to permit fine adjustment of the loading.

The bolt 138 is shown as having a round cross-section. It will be appreciated that it may have a non-circular cross-section defined by one or more flats as disclosed in our European Patent specification 292296.

Whilst it is preferred for the bolt 138 to be screw threadedly received in the bore 131 it will be appreciated that other arrangements are possible where a shaft is axially movable along bore 131 to engage by both the hinge pin 116 and torsion spring.

In order to separate the hinge, bolt 138 is withdrawn. This initially relieves tension on the torsion spring and then on subsequent withdrawal of the bolt 138 it clears the hinge pin and thereby enables axial withdrawal of the hinge pin.

In order to limit maximum opening of the hinge stop means may be provided on the hinge leaves. For example, a projection 160 may be provided on the boss 113 of hinge leaf 111 which projects outwards and downwards to engage hinge leaf 112 when the hinge has been opened by a predetermined maximum amount.

In the illustrated embodiment, both hinge leaves are formed from rolled metal sections. It will be appreciated that each hinge leaf may be cast on/or fabricated from metal plate.

I claim:

1. A checked lift-off hinge assembly including a pair of hinge leaves pivotally connected to one another so as to be separable by relative movement along the axis of the pivotal connection, a torsion spring mounted on one of said hinge leaves, the torsion spring extending towards and being co-operable with one or more reaction members on the other hinge leaf to provide a checking force for resisting relative pivoted movement between the hinge leaves, said one hinge leaf including positional displacement means operable on said torsion spring for moving the torsion spring to relieve spring pressure on the reaction members to thereby enable axial separation of the hinge leaves.

2. A hinge assembly according to claim 1, wherein the displacement means is operable to move said torsion spring to reduce the torsional force of the spring and thereby relieve spring pressure on the one or more reaction members.

3. A hinge assembly according to claim 1, wherein the displacement means is operable to move said torsion spring away from said one or more reaction members and thereby relieve spring pressure thereon.

4. A hinge assembly according to claim 2, wherein said torsion spring includes an elongate body having opposed arms located at opposite ends of the elongate body, a first of said arms being movable and arranged to co-operate with said one or more reaction members and the second arm being constrained such that on movement of said first arm the elongate body portion is caused to twist.

5. A hinge assembly according to claim 4, wherein the displacement means acts upon said second arm, the displacement means being movable to permit the second arm to move under the torsional bias of the elongate body portion and thereby relieve the torsional loading applied to said first arm.

6. A hinge assembly according to claim 5, wherein the displacement means is in the form of a bolt, the bolt having a terminal end in engagement with the second arm, the bolt being movable toward an extended position for moving the second arm to apply torsional loading in said elongate body and being movable toward a retracted position to permit the second arm to move under the bias of the torsional loading applied by the elongate body portion.

7. A hinge assembly according to claim 2, 4, 5 or 6, wherein the pair of hinge leaves are pivotally connected to one another by a hinge pin, the hinge pin being axially withdrawable rom said one hinge leaf, hinge pin lock means being movably mounted on said one hinge leaf for movement between a hinge pin engaging position and a hinge pin release position, said hinge pin lock means being arranged to co-operate with the torsion spring to thereby comprise the displacement means such that when the hinge pin lock means is moved toward its hinge pin engaging position it co-operates with the torsion spring to apply a torsional load and that when the hinge pin lock means is moved toward its hinge pin release position it co-operates with the torsion spring to relieve torsional load.

8. A hinge assembly according to claim 3, wherein said torsion spring includes an elongate body having opposed arms located at opposite ends of the elongate body, a first of said arms being movable and arranged to co-operate with said one or more reaction members and the second arm being constrained such that on movement of said first arm the elongate body portion is caused to twist.

9. A hinge assembly according to claim 8, wherein the displacement means acts upon said first arm, the displacement means being movable to move the first arm away from the one or more reaction members and thereby relieve spring pressure applied thereto.

10. A hinge assembly according to claim 9, wherein said displacement means comprises a rotatable bush received in a bore formed in said one hinge leaf, the bush having an internal bore in which the first arm is located, the bush co-operating with the hinge leaf bore and the first arm such that rotation of the bush causes displacement of the first arm toward or away from the side of the hinge leaf bore.

11. A hinge assembly according to claim 10, wherein the bush is rotatably mounted on the first arm and has a diameter less than the diameter of the hinge leaf bore, the internal bore of the bush being eccentrically located.

12. A hinge assembly according to claim 10, wherein the bush is rotatably mounted in the hinge leaf bore and the internal bore has a diameter greater than the first arm, the internal bore of the bush being eccentrically located.

13. A hinge assembly according to claim 10, wherein the bush is rotatably mounted in the hinge leaf bore and the internal bore has a diameter greater than the first arm, the internal bore of the bush being concentrically located and provided with a flat portion.

14. A checked lift-off hinge assembly including a pair of hinge leaves pivotally connected to one another by a hinge pin so as to be separable by relative movement along the axis of the pivotal connection, a torsion spring mounted on one of said hinge leaves, the torsion spring extending towards and being co-operable with one or more reaction members on the other hinge leaf to provide a checking force for resisting relative pivotal movement between the hinge leaves, the hinge pin being axially withdrawable from said one hinge leaf, hinge pin lock means movably mounted on said one hinge leaf for movement between a hinge pin engaging position and a hinge pin release position, said hinge pin lock means when in the hinge pin engaging position co-operating with the torsion spring to apply a torsional load, the hinge pin lock means when moved to the hinge pin release position being operable on the torsion spring to relieve spring pressure on the reaction members and to also release the hinge pin to thereby enable axial separation of the hinge leaves.

15. A hinge assembly according to claim 14, wherein the hinge pin lock means comprises a screw threaded shaft which is threadably received in a bore extending laterally of the hinge pin bore such that the sides of the hinge pin and threaded shaft mutually abut one another.

16. A hinge assembly according to claim 15, wherein the torsion spring has an end portion which intersects the axis of the shaft bore and is spaced from the shaft bore so as to be engaged by an end portion of the shaft.

* * * * *